US007214148B2

(12) United States Patent
Mahoney

(10) Patent No.: US 7,214,148 B2
(45) Date of Patent: May 8, 2007

(54) BASKETBALL BREAKAWAY GOAL RELEASE APPARATUS

(76) Inventor: Thomas H. Mahoney, 217 Albron, Dorrance, KS (US) 67634

( * ) Notice: Subject to any disclaimer, the term of this patent is extended or adjusted under 35 U.S.C. 154(b) by 164 days.

(21) Appl. No.: 11/026,742

(22) Filed: Dec. 31, 2004

(65) Prior Publication Data

US 2006/0148598 A1 Jul. 6, 2006

(51) Int. Cl.
*A63B 63/08* (2006.01)

(52) U.S. Cl. ..... 473/486

(58) Field of Classification Search ..... 473/476–486
See application file for complete search history.

(56) References Cited

U.S. PATENT DOCUMENTS 4,676,503 A * 6/1987 Mahoney et al. ..... 473/486
5,318,289 A * 6/1994 Mahoney et al. ..... 473/486
5,480,139 A * 1/1996 Owen et al. ..... 473/486
5,628,506 A * 5/1997 Vaught ..... 473/486
5,685,790 A * 11/1997 Vaught ..... 473/486
5,830,090 A * 11/1998 Fitzsimmons et al. ..... 473/486

* cited by examiner

*Primary Examiner*—Stephen Blau
*Assistant Examiner*—M. Chambers

(57) ABSTRACT

A basketball breakaway goal release apparatus, is designed to allow a basketball rim to pivot down under excessive pressure and reset to a normal horizontal playing position. The basketball breakaway goal release apparatus includes 1) a main support base assembly; 2) a basketball goal support assembly pivotally connected along an upper rear edge to the main support base assembly and 3) a positive release actuator mechanism operably mounted to the main support base assembly and the basketball goal support assembly. The positive release actuator mechanism includes a rocker arm assembly pivotally connected at one end to the main support base assembly and engageable with a roller track assembly under adjustable force of a compression spring member. After excess pressure is applied, the rocker arm assembly pivots relative to the roller track assembly to allow the downward pivotal movement of the basketball rim assembly.

18 Claims, 7 Drawing Sheets

FIG. 1
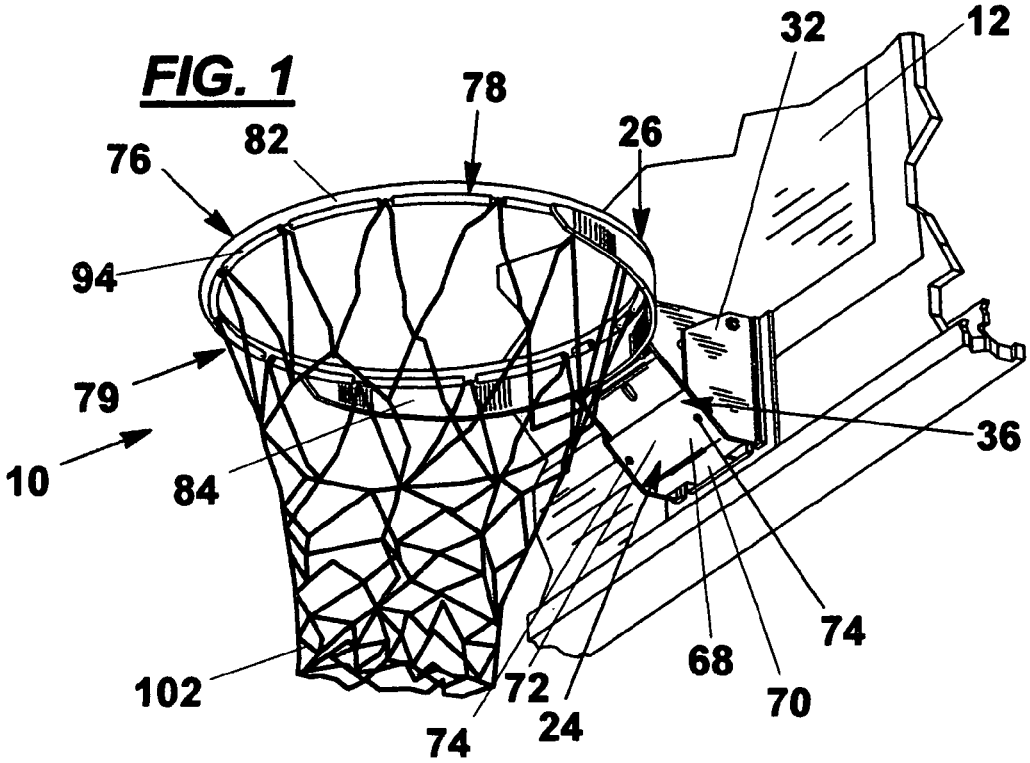
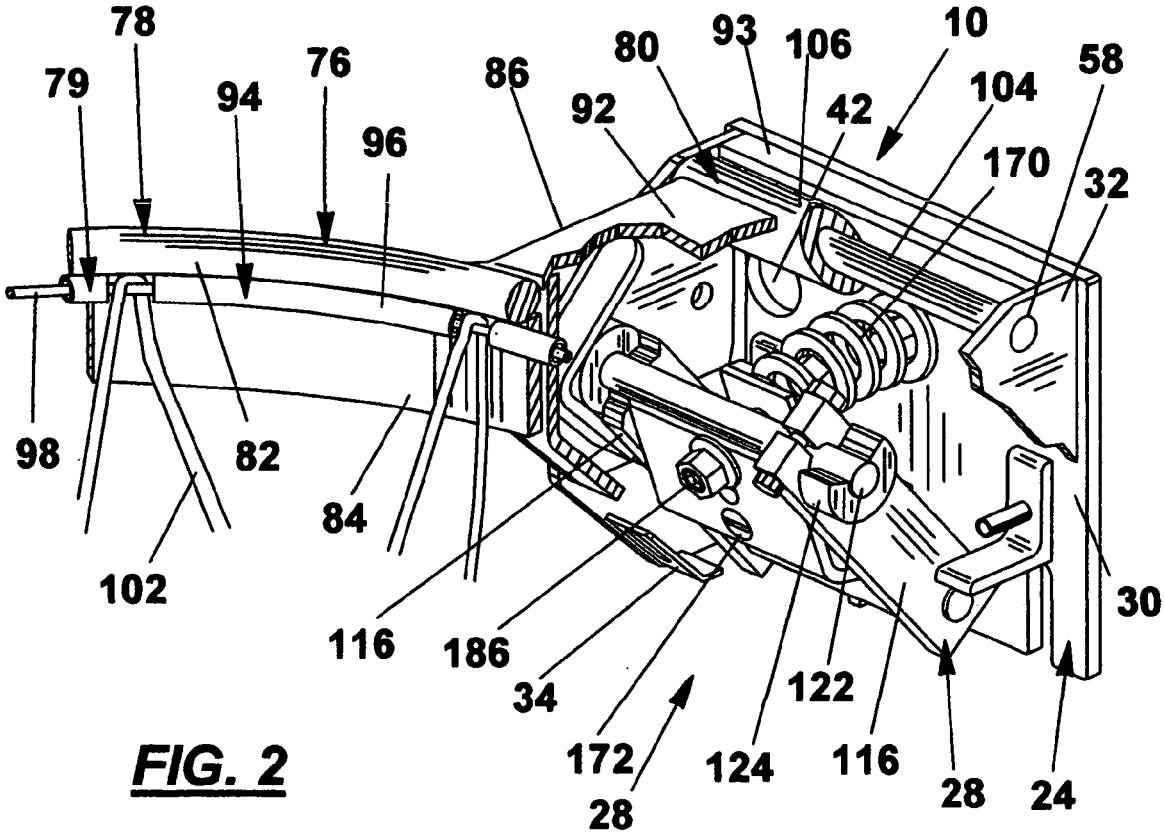
FIG. 2

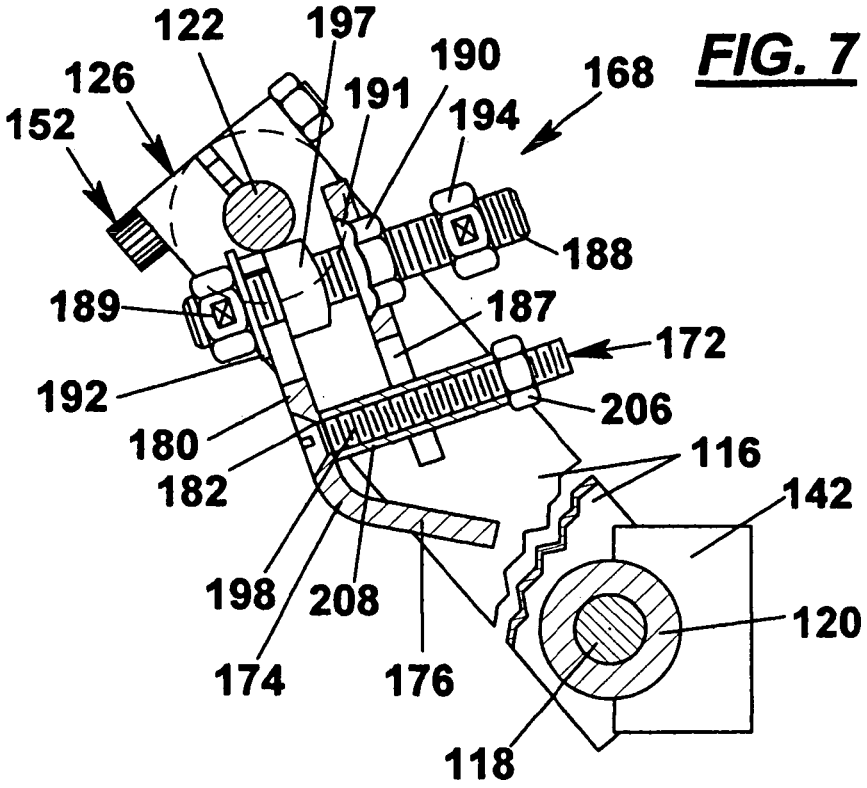
FIG. 7
FIG. 7a
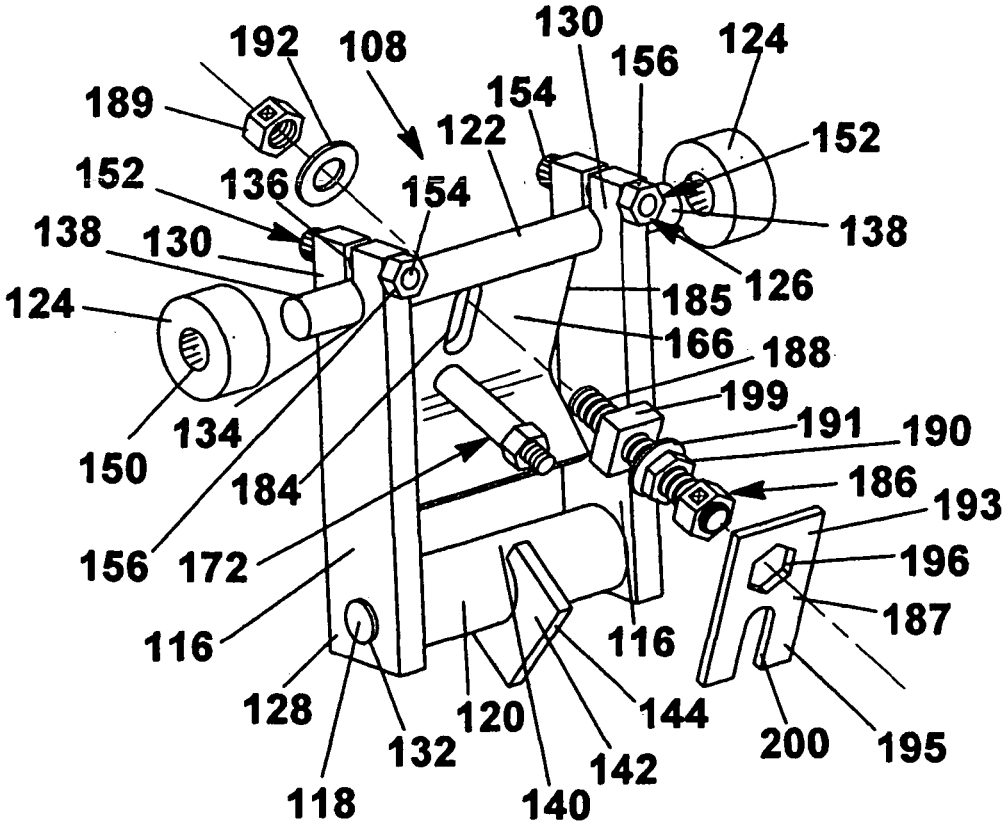

FIG. 8
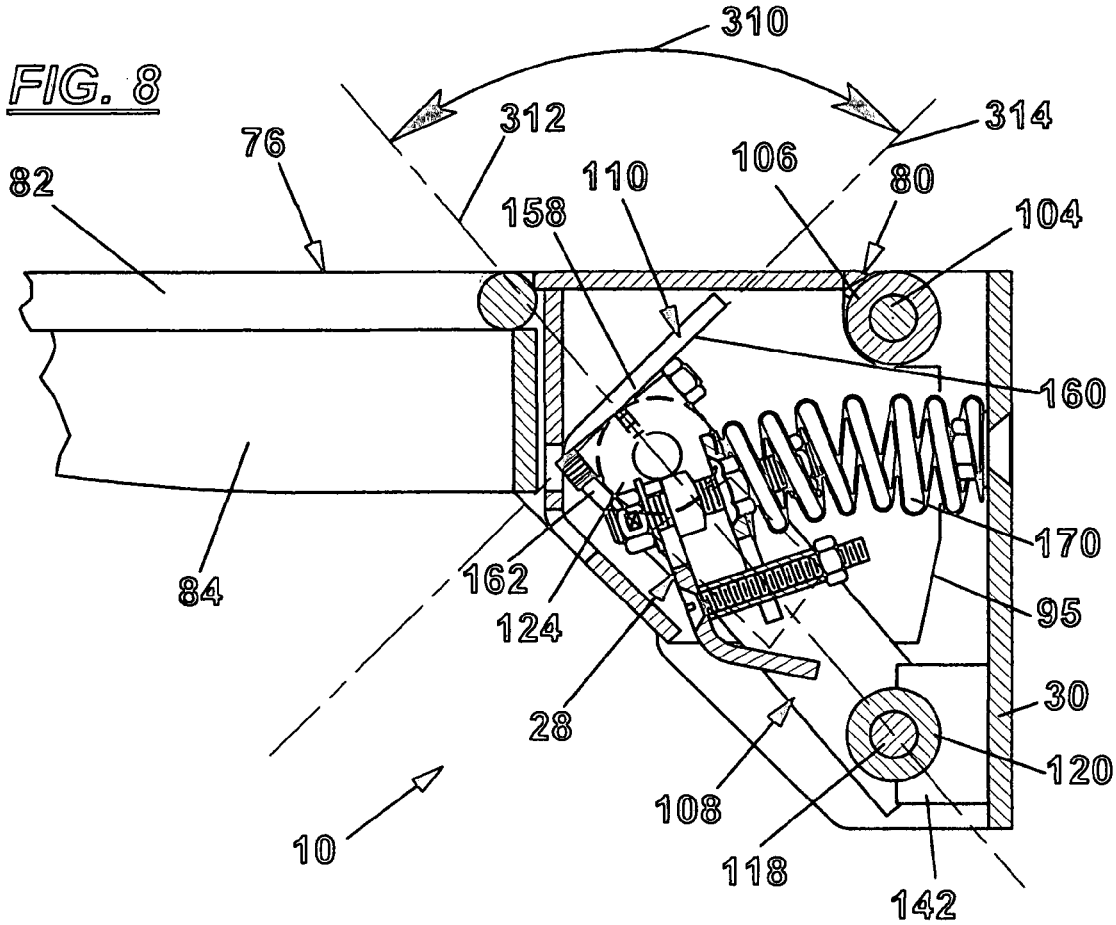
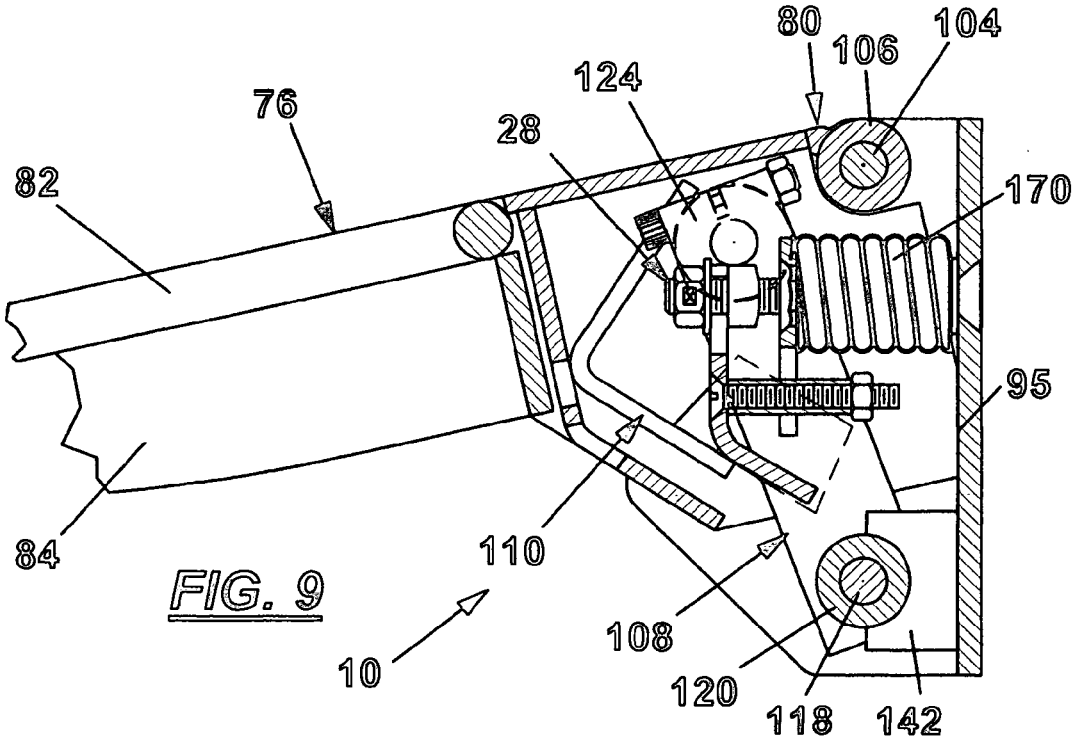
FIG. 9

BASKETBALL BREAKAWAY GOAL RELEASE APPARATUS

PRIOR ART

The applicant herein is very knowledgeable in the area of basketball goal release mechanisms used to release a basketball rim assembly when excessive pressure is applied thereto, such as in a slam-dunk basketball exhibition or game play. The basketball breakaway goal release apparatus is used primarily to prevent breakage of a glass basketball backboard member which is extremely costly on a national television exposure event when it takes thirty or more minutes to replace the shattered glass basketball backboard member. As the applicant is educated in this area and presently manufacturing basketball breakaway goal release apparatus, a patent search was conducted but only two patents are deemed pertinent. The following prior art patents considered pertinent to the invention herein are as follows:

| U.S. Pat. No. | Issued | Invention | Inventor |
|---|---|---|---|
| 4,676,503 | June 1987 | Break-Away Basketball Goal Apparatus | Kenneth J. Mahoney et al |
| 5,318,289 | June 1994 | Break-away Basketball Goal Release Mechanism | Kenneth J. Mahoney et al |

The first patent number, U.S. Pat. No. 4,676,503, was invented by Elmo J. Mahoney and Kenneth J. Mahoney, brothers, in response to activity in the area of basketball sports of shattering glass backboard members during television displays and, thus, a need to solve this problem by having a pressure released basketball goal rim assembly. This patent is not deemed pertinent to the applicant's invention submitted herein as of a "detent" or "latch" goal release mechanism.

The second U.S. Pat. No. 5,318,289 utilizes a breakover basketball goal release mechanism invented by Kenneth J. Mahoney and his son, Thomas H. Mahoney, the sole inventor of the invention herein. U.S. Pat. No. 5,318,289 includes upper and lower breakaway arm members which are pivotally connected to each other and operable to overcome a spring pressure and provide a positive release of a basketball rim and support assembly. However, it is felt that this patent is not pertinent to the inventor's application herein as numerous structural differences in providing areas of wear thus requiring maintenance which cannot easily be achieved unless returned to an origin of manufacture.

BACKGROUND OF THE INVENTION

Breakaway basketball goal release structures have become increasingly popular over the past decades and are believed to provide several benefits to the users of this type of equipment. Benefits include reduced damage to basketball backboard members, improved player safety, reduced stress on the backboard support structure, and adds to the excitement of the game of basketball and related dunking activities.

In the past, there have been numerous attempts to design and develop basketball goal release systems to provide the benefits as described above. Though these attempts have achieved varying degrees of success and/or acceptance, they are nonetheless subject to certain drawbacks. These drawbacks relate to location and geometry of component parts, cost of manufacturing, susceptibility of such parts to damage and wear, and difficulty of service and maintenance.

To date, there are two basic categories of breakaway rims being marketed. They are "positive locking rims" and "non-positive locking rims". Positive locking rims are designed to hold their position until an external force that is placed on a basketball rim reaches a level that will trip the basketball rim loose and allow it to pivot downward. This action relieves lever arm forces on the basketball rim that are being applied to a basketball backboard member and the support structure up to a point that basketball rim rotation is stopped. Non-positive locking rims are simpler structures whereupon, as more external force is applied to a basketball rim, more downward travel in the basketball rim will result. This increase in basketball rotation results in additional force being placed on the backboard and support structure with the maximum force being applied as rotation is stopped.

The advantage to a "positive locking rim" is that it can be set not to release until a preset level of force is applied to the basketball rim. Generally, this type of basketball rim will hold more closely to normal ball rebound characteristics of a standard non-movable basketball rim. "Non-positive locking rims" will generally not hold a normal rebound of a standard non-movable basketball rim unless the holding mechanism is tightened up to a point that basketball rim rotation is virtually eliminated. Of the two basic categories, the "positive locking rim" design is considered to be of higher quality.

Most "positive locking rims" use a detent or latch mechanism that secures the basketball rim in the playing position. The amount of force required to release the basketball rim from the playing positions is usually controlled by spring pressure placed upon a pin or ball that fits into a detent. Although this has been an accepted method for holding the basketball rim in a solid fixed position until an overload force is applied, this system is generally associated with a high degree of friction.

Unless all of the components in this system are in some way hardened so as to prevent wear, this detent or latch type of locking system has a tendency to lose the ability to hold a constant release setting. Therefore, constant maintenance is required on this type "positive locking rims" to ensure that they maintain acceptable levels of performance.

A more recent type of "positive locking" mechanism that has been invented is the breakover arm system and a system of this nature is found in Mahoney et al U.S. Pat. No. 5,318,289 issued Jun. 7, 1994. In this patent, a breakover actuator assembly consisting of breakover arm members which pivotally connected to each other and provides support to a basketball rim assembly with spring type pressure holding the breakover arm members in place. This system eliminates the wear associated with a latch or detent but is subject to considerable wear at the pivot points in the upper and lower breakover arm members and other pivot locations.

SUMMARY OF THE INVENTION

The basketball breakaway goal release apparatus of this invention includes a main support base assembly that is to be bolted to a support structure such as a basketball backboard member. A movable basketball goal support assembly is pivotally connected at a top back edge to the main support base assembly. This pivot point allows rotation of the basketball rim assembly in both the upward and downward directions. This is an important feature of this design since it 1) provides the most uniform downward release pressure across the top of the basketball goal support assembly; and 2) provides a method to open the basketball rim assembly for periodic inspection, maintenance, and replacement of component parts as required over time and use. A pair of parallel actuator link members are pivotally connected at one end to a link pivot shaft at a bottom of the main support base assembly. Upper ends of the actuator link members have a roller support shaft having an actuator roller member mounted on outer ends. The actuator link members are positioned under a base of the basketball rim assembly in such a manner as to provide support to the basketball rim assembly. The actuator roller members are in contact with a roller track assembly that is fixed to a underside of the basketball rim assembly at such an angle so as to allow the actuator link members to hold the basketball rim assembly in the playing position with a relatively small force. However, when an excessive downward force is applied to the basketball rim assembly, the top end of the actuator link member/roller assembly will rotate to the aft position and the basketball rim assembly will freely rotate downwardly.

In another aspect of the invention, this rim design can be serviced without removal from the support structure to which it is attached. The actuator link members can be forcibly rotated rearward by use of an external device, such as a pry bar. This will release the actuator roller members from a pocket formed by the roller track assembly that is fixed to the underside of the basketball rim assembly. At this point, the basketball rim assembly can be rotated upwardly so as to reveal the internal parts of the basketball rim assembly. The basketball rim assembly can be held in the open position with an external cross pin, screw driver or other device that will fit into a hole in a rim support plate of the basketball rim assembly. The actuator link members can then be rotated downwardly to reveal other rim components such as a rubber soft stop members, the actuator roller members, a compression spring member, and an adjuster screw assembly. Additionally, lubrication points for the two main pivot points can now be reached.

In another aspect of the invention, the external downward pressure required to release the basketball rim assembly from the normal playing position can be independently controlled with an adjustment device such as an Allen wrench. This adjustment device can be an externally adjuster screw assembly that acts as a screw jack against the compression spring member that holds the actuator link members and actuator roller members in place.

In another aspect of the invention, when excessive force is applied to the rim, the actuator link members and actuator roller members trip rearward as the basketball rim assembly rotates downwardly. The basketball rim assembly rotation is stopped when the lower portion of the base of the basketball rim assembly contacts the main support base assembly that is attached to the base support structure. This, in itself, prevents the total compression of the compression spring member thus preventing what is known as a "solid column". Preventing a "solid column" is critical to prevent damage to the operating components that make up the positive release actuator mechanism.

In another aspect of the invention, a shock absorbing assembly can be incorporated into a basketball goal support assembly design to prevent sudden stop of the basketball rim assembly when it reaches the bottom of its downward rotation. This components can be positioned directly between the lower portion of the back of the basketball rim assembly and the main support base assembly. This totally by-passes the components that make up the positive release actuator mechanism further preventing a "solid column" situation.

In another aspect of the invention, the downward rotation of the basketball rim assembly relative to a main support base assembly is positively stopped by contact of a stop wall of the basketball rim assembly with a front lower wall of the main support base assembly. This also prevents a "solid column" situation with the compression spring member and is known as a "hard stop".

In another aspect of the invention, the basketball rim assembly will automatically return to the normal playing position. The compression spring member that holds the actuator link members in place when the basketball rim assembly is in the normal playing position also acts to return the basketball rim assembly back to the normal playing position after any external force that released the basketball rim assembly is removed.

PREFERRED EMBODIMENT OF THE INVENTION

In a preferred embodiment of the invention, a basketball breakaway goal release apparatus is provided to be attached to a basketball backboard member to prevent breakage thereof on applying an overload condition to a basketball rim assembly.

The basketball breakaway goal release apparatus includes 1) a main support base assembly which is attached as by a connector assembly to a basketball backboard member; 2) a basketball goal support assembly which includes a basketball rim assembly being pivotally connected to the main support base assembly; and 3) a positive release actuator mechanism operable to be connected between the main support base assembly and the basketball rim assembly.

The positive release actuator mechanism includes 1) a rocker arm assembly engageable with the basketball rim assembly; 2) a roller track assembly operable to engage the rocker arm assembly; and 3) an adjustable bias release assembly operable to maintain the rocker arm assembly and the basketball rim assembly in a horizontal position under normal basketball playing conditions.

The adjustable bias release assembly is operable on release of the rocker arm assembly to automatically return the basketball rim assembly to the normal horizontal basketball playing condition.

The rocker arm assembly is provided with actuator link members that are pivotally connected at a lower end to the main base support assembly and, at an upper end, is engaged with the roller track assembly and operable to pivot the basketball rim assembly on reaching an adjustable, preset pressure thereagainst and being easily adjustable to release on a preset pressure being applied thereto.

The positive release actuator mechanism is operable to maintain the basketball rim assembly in a solid rigid condition until a preset excessive pressure is applied thereto, which then pivots downwardly. Release of pressure on the basketball rim assembly causes an automatic return of the basketball rim assembly to the horizontal basketball playing condition.

OBJECTS OF THE INVENTION

One object of this invention is to provide a basketball breakaway goal release apparatus which can be mounted on any basketball backboard member and being operable to automatically release on excessive pressure applied to a basketball rim assembly and then return the basketball rim assembly to the normal horizontally extended basketball playing condition.

Another object of this invention is to provide a basketball breakaway goal release apparatus that resembles a normal basketball goal support assembly but having a unique mechanism therein for downward pivotal movement of a basketball rim assembly on application of excessive pressure applied thereto while maintaining continuous linkage connections between a main support base assembly and the basketball rim assembly.

One other object of this invention is to provide a basketball breakaway goal release apparatus having a basketball goal support assembly having a basketball rim assembly pivotal about a top main pivot shaft being a solid rigid structure without fluttering effect until a preset adjustable excessive pressure is applied to a hoop ring member and having an adjustable bias release assembly which increases pressure on the basketball rim assembly on pivotal movement so as to aid in the basketball players maintaining control after experiencing a slam-dunk basketball shot and, perhaps, sequential pivotal movement of the basketball rim assembly.

A further object of this invention is to provide a basketball breakaway goal release apparatus including a positive release actuator mechanism and a shock absorbing assembly to provide a cushioning effect on release of the basketball rim assembly and to prevent excessive forces and wear being applied to the overall basketball breakaway goal release apparatus.

Still, one other object of this invention is to provide a basketball breakaway goal release apparatus which is sturdy in construction; new and novel in operation; substantially maintenance free; adjustable and reliable in repeat pressure release operations; readily accessible and easy to perform maintenance operations thereto; and easy to install.

Various other objects, advantages, and features of the invention will become apparent to those skilled in the art from the following discussion taken in conjunction with the accompanying drawings in which:

FIGURES OF THE INVENTION

FIG. 1 is a fragmentary perspective view of a basketball backboard member having a basketball breakaway goal release apparatus of this invention connected thereto;

FIG. 2 is a fragmentary perspective view of the basketball breakaway goal release apparatus of this invention having portions thereof broken away for clarity;

FIG. 7 is an enlarged side elevational view of an adjustable bias release assembly and a portion of a rocker arm assembly;

Figure 10:
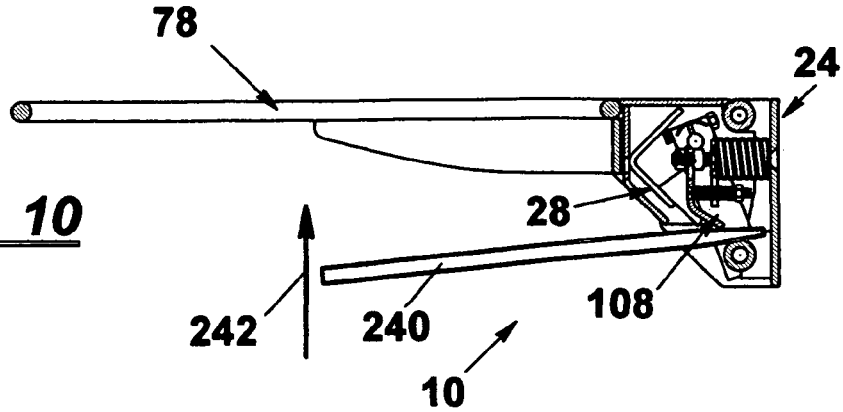
Figure 11:
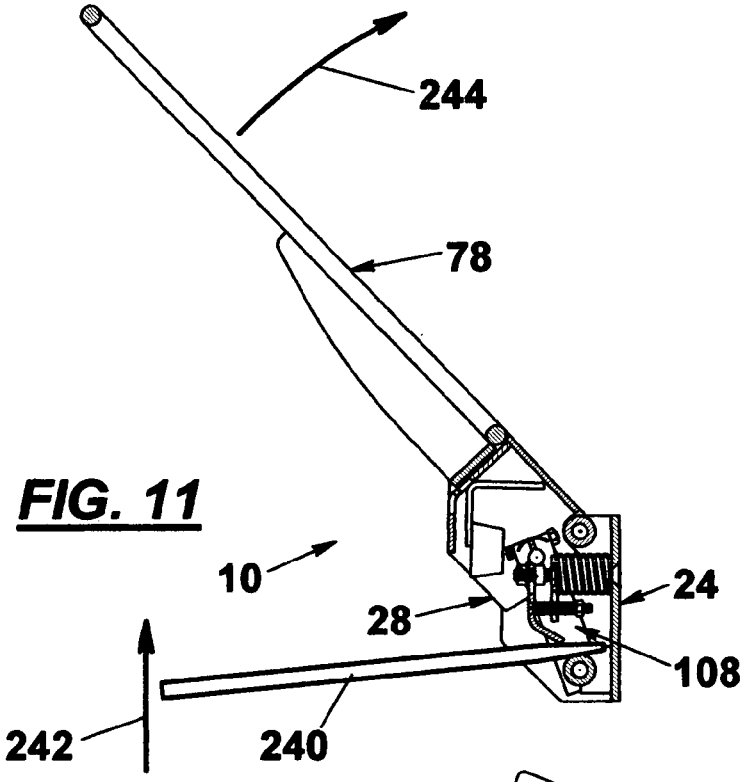
Figure 12:
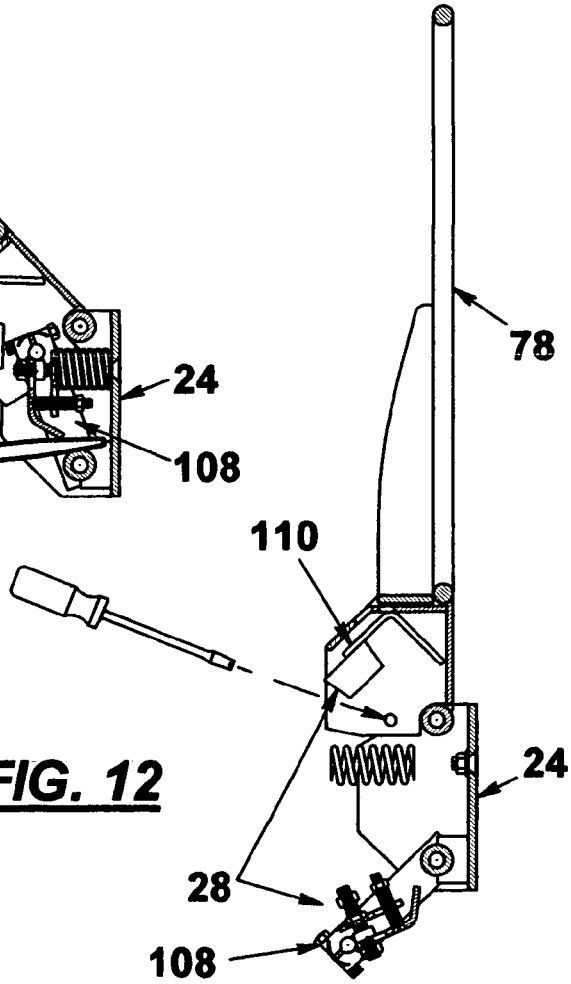

FIG. 7*a* is an exploded perspective view of the rocker arm assembly and details of an adjustable bias release assembly;

FIG. 8 is a schematic side elevational view of the basketball breakaway goal release apparatus in a normal basketball playing condition;

FIG. 9 is a schematic side elevational view similar to FIG. 8 showing the basketball breakaway goal release apparatus in a pressure released condition;

FIG. 10 is a schematic side elevational view showing a pry bar member being used in a maintenance operation;

FIG. 11 is a view similar to FIG. 10 except the basketball goal support assembly is being moved upwardly and downwardly during the maintenance operation; and FIG. 12 is a view similar to FIG. 10 except the basketball goal support assembly is moved to a vertical position during the maintenance operation and held in the vertical position by a screw driver or similar object.

The following is a discussion and description of preferred specific embodiment of the new basketball breakaway goal release apparatus of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

On referring to the drawings in detail and, in particular to FIG. 1, a basketball breakaway goal release apparatus, indicated generally at 10, is shown as attached to a basketball backboard member 12 by a connector assembly 16. The connector assembly 16 includes a plurality, namely four, members 18 with washer members 20 and nut members 22 mounted on respective bolt members 18. (See FIG. 4).

The purpose of the basketball breakaway goal release apparatus 10 is to provide a means of releasing a basketball goal support assembly 26 when excessive pressure is applied thereto, such as occurs when slam-dunking a basketball member and a player grabs a basketball rim assembly 76. This problem came to light when basketball players were shattering glass basketball backboard members while attempting a dunking procedure and it requires thirty minutes or more to replace the now shattered basketball backboard member.

The basketball breakaway goal release apparatus 10 includes 1) a main support base assembly 24; 2) a basketball goal support assembly 26 pivotally connected to the main support base assembly 24; and 3) a positive release actuator mechanism 28 pivotally mounted between the main support base assembly 24 and the basketball goal support assembly 26, as will be described, is releasably connected to the goal support assembly 26.

Figure 3:
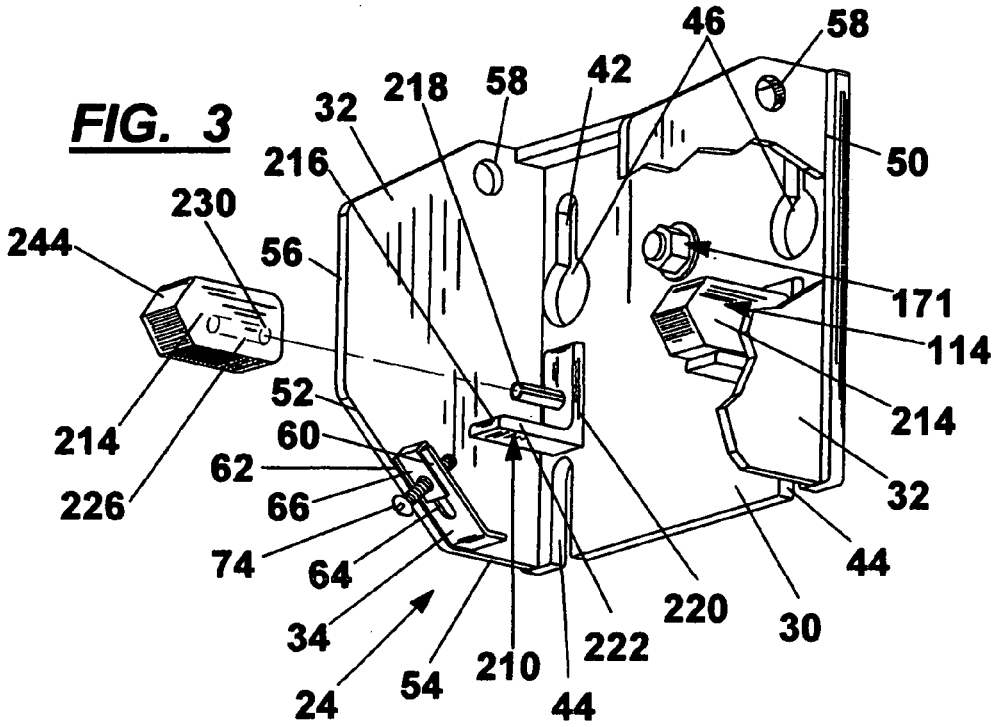
FIG. 3 is a perspective view of the support base member with portions of the positive release actuator mechanism broken away for clarity.
Figure 4:
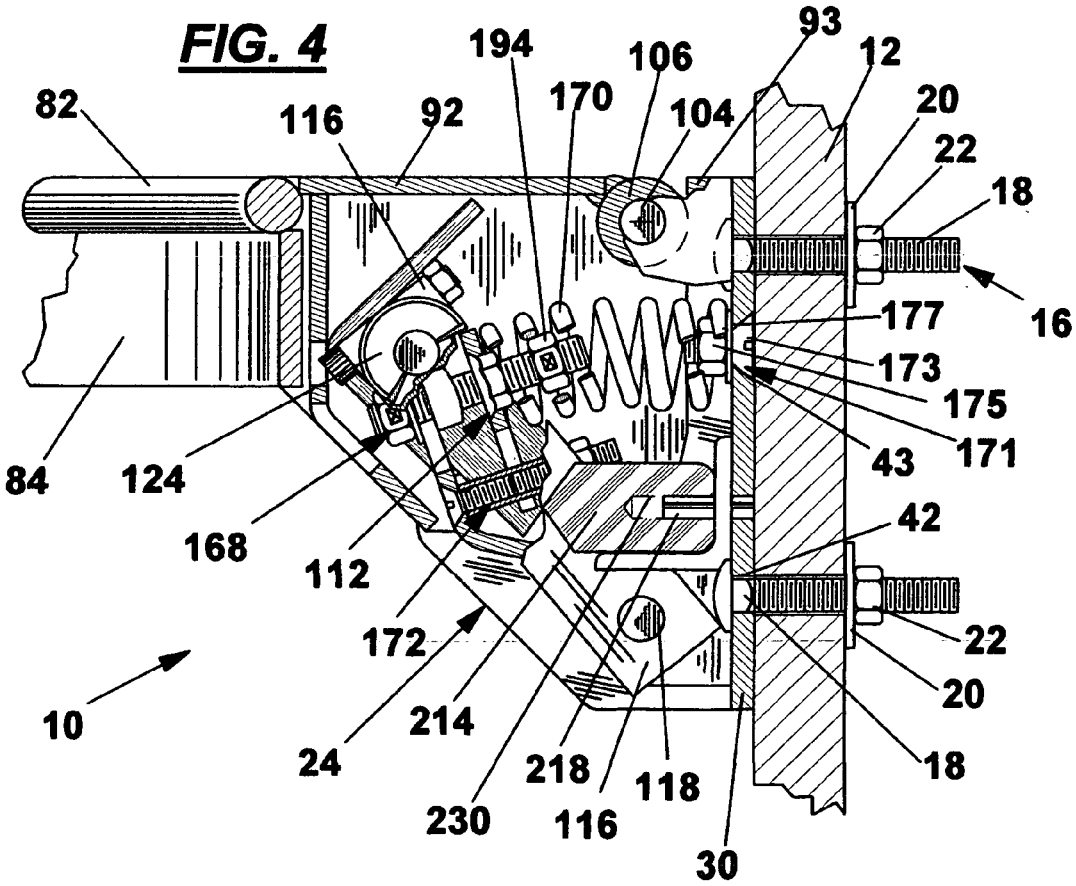
FIG. 4 is a fragmentary side elevational view with portions broken away of the basketball backboard member and the basketball breakaway goal release apparatus connected thereto.

As best illustrated in FIGS. 3 and 4, the main support base assembly 24 includes a support base member 30; a spaced pair of side support plates 32 extended outwardly along outer edges of the support base member 30; and a pair of spaced cover support lugs 34. The support base member 30 is of a generally rectangular plate structure having an anchor support openings 42 therein.

The anchor support openings 42 include a pair of spaced anchor slots 44, a pair of spaced key-shaped anchor openings 46 for ease of mounting and operable to receive the connector assembly 16 therein for anchoring to the basketball backboard member 12, and a central spring bolt alignment opening.

Each side support plate 32 is of an irregular shape having 1) a vertical connector edge 50; 2) cover connector edges 52, 54; 3) a front vertical edge 56; and 4) a top shaft support opening 58.

The pair of side support plates 32 are each provided with the aligned top shaft support openings 58 for pivotal connection by a top main pivot assembly to be described relative to the positive release actuator mechanism 28 as will be noted.

The spring bolt alignment opening 43 is adapted to receive a spring alignment assembly therein as will be described.

Each cover support lug 34 includes a support plate 60 having a connector edge 62, and anchor slot 64, and a connector clip 66 mounted about the anchor slot 64 to receive a cover connector bolt therein as will be noted.

The cover assembly 36 includes 1) a cover member 68; and 2) connector bolts 74 to be mounted in respective connector clips 66 for anchoring purposes.

The cover member 68 has a bottom section 70 integral with an upper section 72 forming a inclined plate structure operable to be placed against the cover connector edges 52, 54 of the side support plate members 32.

As noted in FIG. 1, the basketball goal support assembly 26 includes a conventional basketball rim assembly 76 having 1) a rim assembly 78 connected to a top main pivot assembly 80; and 2) a net tube support assembly 79 connected to the rim assembly 78.

As noted in FIG. 1, the rim assembly 78 includes 1) a hoop ring member 82; 2) a ring support plate 84 of a circular shape and welded to an under surface of the hoop ring member 82; 3) a basketball net assembly 79 is secured to the ring support plate 84; 4) a pair of parallel, spaced rim support plates 86 connected at rear upper edges to the top main pivot assembly 80 and connected as by welding to outer surfaces of the ring support plate 84; and 5) a top connector plate 92 welded to upper edges of the rim support plates 86 and a portion of the main pivot assembly 80 as will be noted.

A safety plate 93 is secured as by welding to upper adjacent edges of the support base member 30 and the side support plates 32. The safety plate 93 functions to close a slot opening to the top main pivot assembly 80 to protect a basketball player from injury should a finger be inserted and caught in the slot opening.

As shown in FIG. 2, the net tube support assembly 79 includes 1) a plurality of spaced support tube segments 96 secured to an undersurface of the hoop ring member 82; 2) a net support rod or wire 98 trained through the support tube segments 96; 3) a basketball net member 85 having upper portions supported on the net support rod 98 between adjacent end wall of the support tube segments 96.

The top main pivot assembly 80 includes 1) a top main pivot shaft 104; and 2) a top main pivot tube 106 mounted about the top main pivot shaft 104.

The top main pivot shaft 104 is mounted within upper top shaft support openings 58 in the respective side support plate members 32 and secured thereto as by welding.

The top main pivot tube 106 is mounted within the openings in the rim support plates 86 and welded thereto and mounted about the top main pivot shaft 104 so as to provide an upper main pivot axis for pivotal movement of the basketball rim assembly 76 from a generally horizontal playing condition to a pressure release condition and, further, pivotally upward to vertical position for ease of maintenance operations thereon as will be explained.

The positive release actuator mechanism 28 includes 1) a rocker arm assembly 108; 2) a roller track assembly 110 operably engageable with the rocker arm assembly 108; 3) and adjustable bias release assembly 112; and 4) a shock absorbing assembly 114.

The arm assembly 108 includes 1) a pair of actuator link members 116; 2) a link pivot shaft 118 connected to inner ends of the actuator link members 116; 3) a link pivot tube 120; 4) a roller support shaft 122; 5) a pair of actuator roller members 124 each respectively connected to outer ends of the roller support shaft 122; and 6) a roller support shaft anchor assembly 126 connected to outer ends of the actuator link members 116.

The identical actuator link members 116 are constructed of a sturdy rectangular sheet steel material and having 1) a pivot tube connector end section 128; and 2) a roller shaft connector end section 130.

The pivot tube connector end section 128 has a pivot shaft opening 132 operable to receive the link pivot shaft 118 therein.

The roller shaft connector end section 130 includes 1) a shaft connector opening 134 to receive and support the roller support shaft 122 therein; and 2) an aligned clamp opening 136 to receive the roller shaft anchor assembly 126 therein as will be explained.

The roller support shaft 122 has outer anchor sections 138, each operable to receive and support an actuator roller member 124 thereon.

The link pivot tube 120 includes an anchor mid section 140 with a pivot tube anchor member 142 connected to the anchor mid section 140. The pivot tube anchor member 142 has a support base anchor edge 144 which is secured as by welding to a lower front wall of support base member 30. (See FIG. 5)

Each actuator roller member 124 resembles a bearing having a central shaft support opening 150 to receive the outer anchor sections 138 of the roller support shaft 122.

The roller support shaft anchor assembly 126 includes a pair of clamp members 152. Each clamp member 15 includes 1) a bolt member 154 to be mounted in one of the aligned clamp openings 136 of the respective roller shaft connector end sections 130; and ) a nut member 156 secured to an outer threaded end of the bolt member 154. The nut member 156 is rotated to provide a clamping action against the outer anchor section 138 of the roller support shaft 122.

Figure 5:
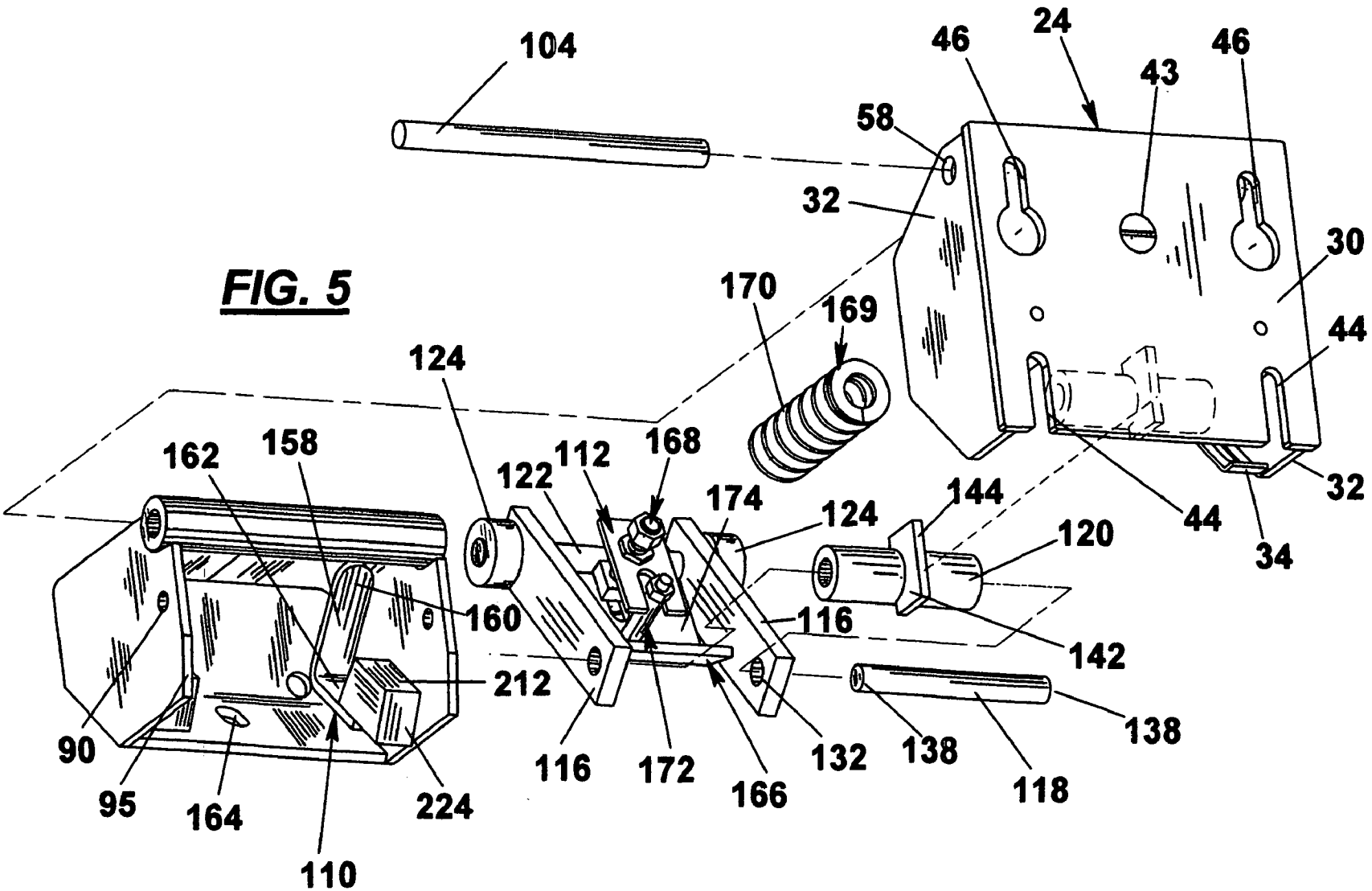
FIG. 5 is an exploded perspective view of a main support base assembly and a positive release actuator mechanism to be pivotally connected to a support base member that is part of the main support base assembly.
Figure 6:
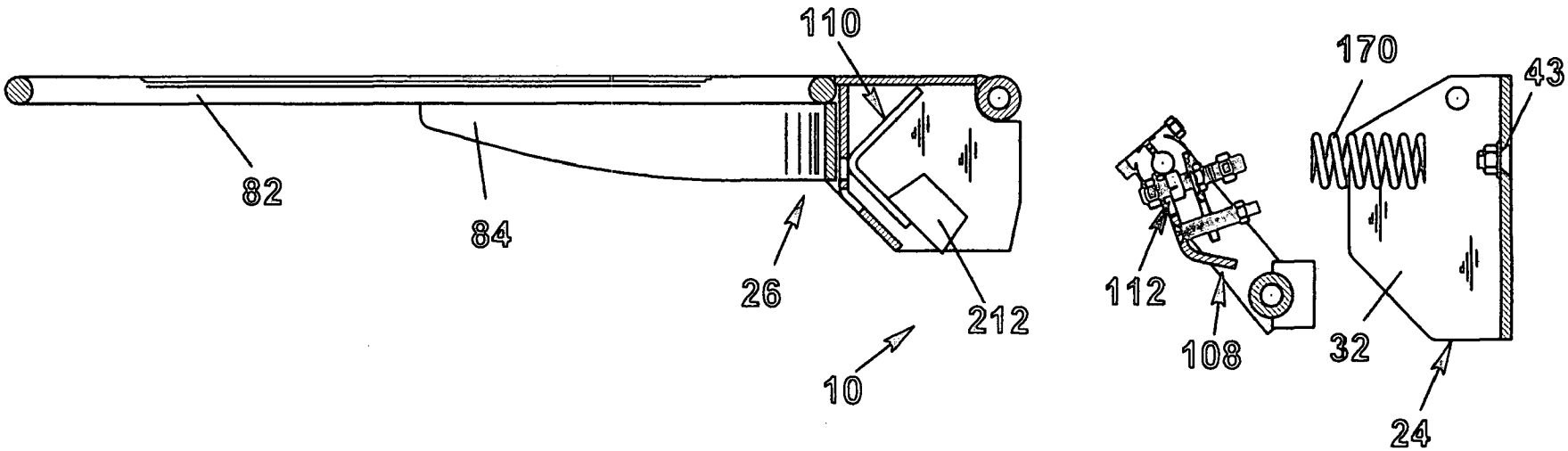
FIG. 6 is an exploded fragmentary side elevational view of a rocker arm assembly and a spring compression adjuster assembly having elements deleted in order to achieve clarity.

As shown in FIG. 5, the roller track assembly 110 includes a pair of roller track members 158 having an upper leg section 160 which is integral with a lower leg section 162 and each leg section 160, 162 is extended substantially ninety degrees to each other.

The adjustable bias release assembly 112 includes 1) a spring adjuster support plate assembly 166; 2) a spring compression adjuster assembly 168; 3) a compression spring assembly 169; and 4) a spring alignment assembly 172.

The spring adjuster support plate assembly 166 includes an adjuster plate member 174 having a lower first leg section 176 integral with an upper second leg section 180 to form an angle there between and having outer vertical edges 185.

The outer vertical edges 185 are secured as by welding to adjacent inner surfaces of the actuator link members 116 as shown in FIG. 7*a*.

The second leg section 180 has 1) an alignment anchor hole 182 to receive part of the spring alignment assembly 172 therein as will be explained; 2) and adjustment slot 184 extended vertically and operable to receive a portion of the spring compression adjuster assembly 168 therein. The spring compression adjuster assembly 168 includes 1) an adjuster screw assembly 186; and 2) a spring adjuster plate 187.

The adjuster screw assembly 186 includes 1) an adjuster screw member 188; 2) a locked nut member 189 connected to an outer end of the adjuster screw member 188; 3) a washer member 192 mounted on the adjuster screw member 188 and positioned in abutting relation to an outer surface of the second leg section 180; and 4) an anti-rotation, square nut member 197 secured as by welding to an inner end of the adjuster screw member 188 and being non-rotatable thereon; 5) a rotation flange nut member 190 mounted about the adjuster screw member 188 and being rotatable thereon; and 6) a limit or lock nut member 194 mounted on an inner end of the adjuster screw member 188 and being non-rotatable thereon.

The spring adjuster plate member 187 is of a generally rectangular plate steel construction having a receiving spring end section 193 which is integral with an alignment end section 195.

The spring receiving end section 193 is provided with an adjuster screw opening 196 therein of irregular shape to receive the adjuster screw member 188 there through and encloses the rotation flange nut member 190. A flange 191 on the rotation flange nut member 190 plus spring pressure against the spring receiving section 193 holds the rotation flange nut member 190 within the adjuster screw opening 196. This allows the adjuster screw member 188 to rotate and the flange nut member 190 to move axially to achieve an adjustment feature of the compression spring member 170 to set release pressure of the basketball rim assembly 76.

The adjuster screw opening 196 irregular shape is a hexagonal or 6 sided shape to receive the rotation flange nut member 190 and having an outer surface of hexagonal shape prevents relative rotation between the flange nut member 190 and the adjuster plate member 187.

As noted in FIG. 7, the lock nut member 189, the washer member 192, and the anti-rotation square nut member 197 are fixed on the adjuster screw member 188 so as to clamp the adjuster plate member 174 there between but allow rotation of the adjuster screw member 188 in order to adjust rim release pressure from the compression member 170.

The spring adjuster plate member 187 is connected to the rotation flange nut member 190 and provides axial movement on the adjuster screw member 188 in a spring adjustment function.

The alignment end section 195 is provided with an alignment slot 200 therein to receive the spring alignment assembly 172 there through as will be noted.

The alignment slot 197 is operable to receive the spring alignment assembly 172 therein and prevent rotation of the interconnected spring adjuster plate member 187 and the rotation flange nut member 190.

As noted in FIG. 7, the anti-rotation square nut member 197 with one of it's four flat sides 199 against an outer surface of the roller support shaft 122 is held in this anti-rotation feature of the adjuster screw member 188 under force of the compression spring member 170. (See FIGS. 4 and 8)

The compression spring member 170 in the curved, normal playing condition (FIG. 4) forces a flat side 199 of the anti-rotation square nut member 197 into contact with the roller support shaft 122 to restrict rotation of the adjuster screw member 188.

During a spring adjustment procedure, Allen wrench outer hexagonal end is inserted into the tool receiving outer end of the adjuster screw member 188 and rotated in selecting the rim release pressure received from the compression spring member 170. This caused downward movement of the adjuster screw assembly 168 in the adjustment slot 184 until a corner of the anti-rotation square nut member 197 loses contact with the roller support shaft 122.

Then, the compression spring 170 forces a flat side 199 into contact with the roller support shaft 122 and the spring force holds the adjuster screw member 188 to prevent undesired rotation thereof.

The compression spring member 170 is of a predetermined strength and size and being compressible to adjust the compression pressure to be obtained therefrom. The compression spring member 170 has a plurality of integral coil portions and flat support surfaces on outer ends thereof.

The spring alignment assembly 172 includes 1) an alignment bolt member 198; 2) a lock nut member 206 mounted about the alignment bolt member 198; and 3) a guide sleeve member 208 mounted about the alignment bolt member 198. The alignment bolt member 198 is inserted into the anchor hole 182 in the second leg section 180 of the adjuster plate member 174 and extended toward the support base member 30.

The guide sleeve member 208 is mounted about alignment bolt member 198 and anchored thereto by the lock nut member 206.

The shock absorbing assembly 114 includes 1) a stop support assembly 210; 2) stop support members 216, 3) stop contact members 212; and 4) soft stop members 214.

The stop support assembly 210 includes a pair of stop support member 216 of L-shape each having a stop support shaft 218 to receive a soft stop member 214 mounted thereon.

The stop support member 216 has 1) an anchor leg section 220 secured as by welding to the front wall of the support base member 30; and 2) a stop support section 222 which is operable to support the stop support shaft 218 mounted thereon.

The stop contact members 212 have outer stop contact surfaces 224 which abut the soft stop members 214 when the basketball goal support assembly 26 is in a pressure released condition.

Each of the soft stop members 214 are preferably made of a resilient rubber material having a main body section 226 integral with inclined stop contact surfaces 244 on an outer contact end thereof.

The main body section 226 has a support shaft opening 230 to receive the stop support shaft 218 of the stop support assembly 210.

The association between the rocker arm assembly 108 and roller track assembly 110 are such, that a center line 312 passing through the center point or longitudinal axis of both the link pivot shaft 118 and roller support shaft 122 must be at an angle as indicated by an arcuate line 310 of less than ninety degrees in relationship to a line 314 that runs true to the surface of the upper leg section 160 of the roller track assembly 110. The angle indicated by an arcuate line 310 must not be less then an angle that is useful in holding the basketball goal support assembly 26 in the normal playing position. The angle indicated by an arcuate line 310 is dependent on the spring force of compression spring member 170 when the positive release actuator mechanism 28 is in the locked position as indicated in FIG. 8. Spring force is controlled by adjustments made to the spring compressor adjustor assembly 168.

USE AND OPERATION OF THE INVENTION

In the use and operation of this invention, the basketball breakaway goal release apparatus 10 is secured to the basketball backboard member 12 by the connector assembly 16. Limited adjustment of the main support base assembly 24 to the basketball backboard member 12 can be accomplished due to anchor slots 44 and the key shaped anchor openings 46. The key shaped anchor openings 46 are important as the upper bolt members 18 with the washer members 20 and nut members 22 are connected to respective bolt members 18 and the nut and bolt members can be first inserted into the proper holes in the basketball backboard member 12.

The basketball breakaway goal release apparatus 10 can then be elevated to place the upper outer heads of the bolt members 18 through the large hole portions of the key shaped anchor openings 46.

The basketball breakaway goal release apparatus 10 is then lowered about the upper bolt members 18 which provides vertical support. The other bolt members 18 can be inserted in the respective anchor slots 44 and all of the nut members 22 can then be tightened.

The basic basketball breakaway goal release apparatus 10 includes the main support base assembly 24 which is bolted securely to the support structure, such as the basketball backboard member 12. The basketball goal support assembly 26 is pivotally connected to the support base member 30 at the top thereof. This pivot point provides rotation of the rim assembly 78 in both upward and downward directions. This is an important design feature since it 1) provides the most uniform downward release pressure across the top of the basketball rim assembly 76; and 2) provides a method to open up the basketball rim assembly 76 for periodic inspection, maintenance, and replacement of component parts as may be required over time and usage.

The rocker arm assembly 108 includes the actuator link members 116. The link members 116 are positioned under the base of the basketball goal support assembly 26 in such a manner as to provide support to the basketball rim assembly 76.

As noted in FIGS. 8 and 9, the roller members 124 on the outer ends of the actuator link members 116 are in contact with the roller track assembly 110 that is affixed to the underside of the basketball rim assembly 76 at such an angle as to allow the actuator link members 116 to hold the basketball rim assembly 76 in the playing position with a relatively small force. But, when an excessive downward force is applied to the basketball rim assembly 76, a top end of the rocker arm assembly 108 will rotate to an aft position (FIG. 9) and the basketball rim assembly 76 will rotate downwardly to prevent breakage of the basketball backboard member 12.

After the excessive downward force is released from the basketball rim assembly 76, the compression spring member 170 will return the basketball rim assembly 76 to the normal position as shown in FIG. 8.

In another important feature of this invention, the basketball breakaway goal release apparatus 10 can be readily serviced without being removed from the support structure, namely the basketball backboard member 12, to which it is attached.

First, the rocker arm assembly 108 can be forcibly rotated rearward by using an external device, such as a pry bar member 240 inserted between the link pivot tube 120 and the adjuster plate member 174 as shown in FIG. 10. The pry bar member 240 is rotated upwardly as noted by an arrow 242 in FIG. 10. This will release the actuator roller members 124 from the rocker track members 158 that are affixed to the underside of the basketball rim assembly 76. At this point, the basketball rim assembly 76 can be rotated upwardly as shown in FIG. 10 by an arrow 244 so as to reveal the internal parts thereof.

As shown in FIG. 12, the basketball rim assembly 76 can be held in the open position with an external cross pin, screwdriver, or other device that will fit into one of the maintenance holes 90 in the rim support plates 86 of the basketball rim assembly 76.

The rocker arm assembly 108 can then be rotated downward as shown in FIG. 12 to reveal components of the positive release actuator mechanism 28 such as the soft stop member 214, the actuator roller members 124, the compression spring member 170, the spring compression adjuster assembly 168, and the spring alignment assembly 171.

Additionally, the two main pivot points of the top main pivot assembly 80 and the actuator link members 116, plus the actuator roller members 124, can now be cleaned and easily lubricated.

One other aspect of the invention is that the external downward pressure required to release the basketball rim assembly 76 from the normal playing position can be independently controlled with an adjustment device such as an Allen wrench used to rotate the adjuster screw member 188 to increase or decrease pressure on the compression spring member 170.

Another aspect of the invention, when excessive force is applied to the basketball rim assembly 76, the rocker arm assembly 108 moves rearward as the basketball rim assembly 76 rotates downwardly. (See FIG. 9)

This downward movement of the basketball rim assembly 76 is stopped when the stop contact members 212 contact the support stop members 214 connected to the stop support assembly 210 which, in turn, is connected to a front wall of the support base member 30 of the main support base assembly 24. This in itself prevents the total compression of the compression spring member 170 and prevents what is know as a "solid column" within the components of the compression spring member 170. Preventing a "solid column" in compression of the compression spring member 170 is critical in preventing damage to the operating components that make up the basketball breakaway goal release apparatus 10.

In the case of extreme pressure on the basketball rim assembly 76, the invention provides safety during a "hard stop" condition wherein the inclined hard stop surfaces 95 on the rim support plates 86 contact the front wall of the support base member 30 to prevent the "solid column" condition on the compression spring member 170 to prevent damage to the operating components of the positive release actuator mechanism 28.

The inclined angle of the hard stop surfaces 95 is designed to achieve parallel wall contact with the abutting surface of support base member 30.

It is seen that the basketball breakaway goal release apparatus 10 of this invention is unique in operation and maintains the actuator link members 116 with a minimum amount of pivotal movement to prevent excessive wear thereon.

The basketball breakaway goal release apparatus 10 is sturdy in construction, reliable in forces to cause breakaway conditions, and substantially maintenance free.

While the invention has been describe in conjunction with a preferred specific embodiment thereof, it will be understood that this description is intended to illustrate and not to limit the scope of the invention, which is defined by the following claims:

I claim:

1. A basketball breakaway goal release apparatus secured to a basketball backboard member to prevent damage thereto when excessive pressure is applied to a basketball rim member, compromising:

a) main support base assembly connected to the basketball backboard member;

b) a basketball goal support assembly including a basketball rim assembly pivotally connected to said main support base assembly;

c) a positive release actuator mechanism having 1) a roller track assembly connected to said basketball goal support assembly; and 2) a rocker arm assembly having an actuator link member pivotally connected at the lower end to said main support base assembly; and having an actuator roller member connected to an upper end thereof; whereby said actuator roller member moves upwardly and rearwardly in the released condition to increase the spring pressure to assure return movement of said basketball rim assembly to the horizontal basketball game playing condition upon release of pressure on said basketball rim assembly;

d) said rocker arm assembly engages said roller track assembly under spring pressure to hold said basketball rim assembly in a horizontal basketball game playing condition;

e) said positive release actuator mechanism includes an adjustable bias release assembly mounted between said rocker arm assembly and said main support base assembly to hold said basketball rim assembly in a horizontal basketball playing condition; and f) said positive release actuator mechanism operates on receiving a predetermined downward pressure on the basketball rim assembly to cause a goal released condition and said basketball rim assembly pivots downwardly.

2. The basketball breakaway goal release apparatus of claim 1, wherein:

a) main support base assembly includes a support base member having a pair of spaced parallel side support plates with aligned top shaft support openings to receive and support said top main pivot assembly therein; and b) said top main pivot assembly connected to an upper end of said support base member and said rocker arm assembly pivotally connected to a lower end of said support base member.

3. The basketball breakaway goal release apparatus of claim 1, wherein:

a) said rocker arm assembly having a pair of said actuator link member each having one of said actuator roller members on an outer end thereof and pivotal conjointly;

b) said roller track assembly includes a pair of roller track members;

c) each of said roller track members engageble with a respective one of said actuator roller members; and d) said actuator roller members movable on respective said roller track members from the basketball game playing condition to the goal released condition.

4. The basketball breakaway goal release apparatus of claim 1, wherein:

a) said adjustable bias release assembly includes 1) a spring adjuster support plate assembly connected to said rocker arm assembly; 2) a spring compression adjuster assembly engageble with said spring adjuster support plate assembly; and 3) a compression spring member connected to said spring compression adjuster assembly and a support base member of said main support base assembly; and b) said spring compression adjuster assembly operable to move said compression spring member to adjust the spring pressure to hold said basketball rim assembly in the horizontal basketball game playing condition.

5. The basketball breakaway goal release apparatus of claim 4, wherein:

a) said adjustable bias release assembly includes a spring alignment assembly operable connected to said spring compression adjuster assembly and secured to said spring adjuster support plate assembly to assure proper spring adjustment operation of said spring compression adjuster assembly.

6. The basketball breakaway goal release apparatus of claim 4, wherein:

b) said spring compression adjuster assembly includes 1) an adjuster screw assembly having an adjuster screw member with and outer end extended through a slot in said spring adjuster support plate assembly; and 2) a spring adjuster plate mounted on said adjuster screw member and movable axially thereon on rotation of said adjuster screw member; and c) said spring adjuster plate receives and supports a moveable end of said compression spring member to adjust the spring pressure on rotation of said adjuster screw member.

7. A basketball breakaway goal release apparatus secured to a basketball backboard member to prevent damage thereto when excessive downward pressure is applied to a basketball rim member, comprising:

a) main support base assembly connected to the basketball backboard member;

b) a basketball goal support assembly including a basketball rim assembly pivotally connected to said main support base assembly;

c) a positive release actuator mechanism having 1) a roller track assembly connected to said basketball goal support assembly; and 2) a rocker arm assembly having an actuator link member pivotally connected at the lower end to said main support base assembly; and having an actuator roller member connected to an upper end thereof; whereby said actuator roller member moves upwardly and rearwardly in the released condition to increase the spring pressure to assure return movement of said basketball rim assembly to the horizontal basketball game playing condition upon release of pressure on said basketball rim assembly;

d) said positive release actuator mechanism includes an adjustable bias release assembly to hold said basketball rim assembly in a horizontal basketball playing condition, said adjustable bias release assembly including a spring compression adjuster assembly having and adjuster screw assembly engageable with said roller track member and a compression spring member, said compression spring member having an inner, non-moveable end engaging said main support base assembly; whereby said spring compression adjuster assembly is operable to axially move said compression spring member to adjust spring pressure operable to release said basketball rim assembly; and e) said positive release actuator mechanism operates on receiving a predetermined downward pressure on said basketball rim assembly when in a horizontal position to cause a released condition and said basketball rim assembly pivots downwardly.

8. The basketball breakaway goal release apparatus of claim 7, wherein:

a) said main support base assembly includes 1) a support base member adapted to be connected to the basketball backboard member to hold said basketball rim assembly in an elevated basketball playing condition; 2) a pair of spaced parallel side support plates secured to respective outer vertical edges of said support base member; and 3) said side support plates having pivot means thereon to receive and pivotally support said basketball rim assembly thereon for movement from the horizontal basketball game playing condition to the release condition.

9. The basketball breakaway goal release apparatus of claim 8, wherein:

a) said basketball rim assembly includes a rim assembly connected to a top main pivot assembly; and b) said top main pivot assembly pivotally connected to said pivot means on said side support plates.

10. The basketball breakaway goal release apparatus of claim 7, wherein:

a) said actuator link member having an actuator roller member rotatably connected to said another end of said actuator link member.

11. The basketball breakaway goal release apparatus of claim 10, wherein:

a) said rocker arm assembly includes a pair of interconnected, parallel actuator link members to provide extra support to said basketball rim assembly.

12. The basketball breakaway goal release apparatus of claim 7, wherein:

a) said spring compression adjuster assembly includes 1) an adjuster screw assembly with an adjuster screw member; and 2) an adjuster plate member connected to said adjuster screw member and movable axially thereon to adjust spring pressure on said compression spring member.

13. The basketball breakaway goal release apparatus of claim 7, wherein:

a) said positive release actuator mechanism includes a shock absorbing assembly having resilient stop contact members connected to said main support base assembly and engageable with said main basketball rim assembly in the release condition to prevent damage to said compression spring member and said spring compression adjuster assembly.

14. A basketball breakaway goal release apparatus secured to a basketball backboard member to prevent damage thereto when excessive downward pressure is applied to a basketball rim member, comprising;

a) a main support base assembly connected to the basketball backboard member;

b) a basketball goal support assembly including a basketball rim assembly pivotally connected to said main support base assembly;

c) a positive release actuator mechanism having 1) a roller track assembly connected to said basketball goal support assembly; and 2) a rocker arm assembly having an actuator link member pivotally connected at the lower end to said main support base assembly; and having an actuator roller member connected to an upper end thereof; whereby said actuator roller member moves upwardly and rearwardly in the released condition to increase the spring pressure to assure return movement of said basketball rim assembly to the horizontal basketball game playing condition upon release of pressure on said basketball rim assembly;

d) said positive release actuator mechanism includes a rocker arm assembly connected to said main support base assembly and engageable with a roller track assembly an adjustable bias release assembly to hold said basketball rim assembly in a horizontal basketball playing condition; and e) said positive release actuator mechanism operates on receiving a predetermined downward pressure on said basketball rim assembly when in a horizontal position to cause a released condition and said basketball rim assembly pivots downwardly, said positive release actuator mechanism having a shock absorbing assembly with stop contact members, hard stop members, and soft contact members operable to prevent a compression spring member from becoming a solid column and being damaged, said hard stop members prevent said compression spring member from becoming a solid column when said soft contact members compression capacity is exceeded or when said soft stop members are removed from said basketball breakaway goal.

15. The basketball breakaway goal release apparatus of claim 14, wherein:

a) said rocker arm assembly is pivoted out of contact with said roller track assembly and said basketball rim assembly is then pivoted upwardly to extend vertically and operable to be held in this position by a tool mounted in a maintenance hole in said basketball rim assembly; whereby a maintenance operation can replace and lubricate parts such as support shafts, roller members, replace soft stop members and hard stop members, and any other parts subject to wear.

16. A basketball breakaway goal release apparatus secured to a basketball backboard member to prevent damage thereto when excessive pressure is applied to a basketball rim member, comprising:

a) main support base assembly connected to the basketball backboard member;

b) a basketball goal support assembly including a basketball rim assembly pivotally connected to said main support base assembly;

c) a positive release actuator mechanism having 1) a roller track assembly connected to said basketball goal support assembly; and 2) a rocker arm assembly having an actuator link member pivotally connected at the lower end to said main support base assembly; and having an actuator roller member connected to an upper end thereof; whereby said actuator roller member moves upwardly and rearwardly in the released condition to increase the spring pressure to assure return movement of said basketball rim assembly to the horizontal basketball game playing condition upon release of pressure on said basketball rim assembly;

d) said rocker arm assembly engaging said roller track assembly under spring pressure to hold said basketball rim assembly in a horizontal basketball game playing condition.

17. The basketball breakaway goal release apparatus of claim 16, wherein: a center line passing through said rocker arm and a line running true to the surface of said roller track assembly define an angle of less than ninety degrees when measured between the line running true to the surface of said roller track assembly and the portion of the center line passing through said rocker arm which extends away from said roller track assembly and opposite said rocker arm.

18. The basketball breakaway goal release apparatus of claim 17, wherein:

a center line passing through said rocker arm and a line running true to the surface of said roller track assembly define an angle of less than ninety degrees when measured between the line running true to the surface of said roller track assembly and the portion of the center line passing through said rocker arm which extends away from said roller track assembly and opposite said rocker arm and said angle is sufficiently large such that said spring pressure is sufficient for holding said basketball rim assembly in a horizontal basketball game playing condition.

* * * * *